US005386989A

United States Patent [19]

Broadway

[11] Patent Number: 5,386,989

[45] Date of Patent: Feb. 7, 1995

[54] ELASTICIZED BALL GAME

[76] Inventor: Robert M. Broadway, 2700 Aquitaine Avenue, Suite 2212, Mississauga, Ontario, Canada, L5N 3J6

[21] Appl. No.: 212,943

[22] Filed: Mar. 15, 1994

[30] Foreign Application Priority Data

Mar. 18, 1993 [CA] Canada ..... 2091914

[51] Int. Cl.[6] ..... A63B 69/38

[52] U.S. Cl. ..... 273/29 A; 273/26 E; 273/58 C; 273/411; 273/413

[58] Field of Search ..... 273/26 E, 29 A, 58 C, 273/411

[56] References Cited

U.S. PATENT DOCUMENTS 1,708,796 4/1929 Lawrence ..... 273/29 A 4,216,960 8/1980 Nicholls ..... 273/29 A

FOREIGN PATENT DOCUMENTS 140131 8/1930 Switzerland ..... 273/29 A

*Primary Examiner*—William H. Grieb

*Attorney, Agent, or Firm*—Shoemaker and Mattare, Ltd.

[57] ABSTRACT

An elasticized ball game is provided in which a ball is attached to one end of a first elastic cord, the other end of which is attached to the ends of two further elastic cords, the free ends of the latter two cords being connected to two spaced-apart posts. In a preferred embodiment, a non-elastic cord is strung under tension between the posts, and the free ends of the second two elastic cords are mounted to the non-elastic cord adjacent its opposite ends.

5 Claims, 2 Drawing Sheets

ELASTICIZED BALL GAME

BACKGROUND OF THIS INVENTION

To play a game of tennis normally requires good weather and a dry suitable surface for a tennis court. The same conditions are also required if a player wants to exercise and practice his/her strokes or practice eye, hand and ball coordination skills. The player will also normally need to find a suitable partner to play against in order to test his/her skills. Many players do not own their own tennis courts and therefore have to book in advance the use of a court. Many tennis players have found it useful to hit a ball against a hard wall for practice purposes. The problem here is that a suitable wall or building is not always readily available or accessible. If the ball goes astray there is also the chance of the loss of the ball or the risk of property damage or personal injury...

PRIOR ART

Some products have entered the market that use an elastic cord attached to a modified tennis ball at one end and a heavy anchor weight at the other. The ball is served in the normal way a tennis ball is served and its trajectory is normally in an arc where it strikes the ground at a position adjacent to the position of the player at the other side of the anchor weight. The ball hits the ground and may under certain circumstances have enough bounce to come back weakly to the player. The problem with this is that, unless the playing surface is both dry and very hard like concrete, the ball does not bounce strongly enough to return to the player let alone have enough velocity at its return to give the player a realistic play of the ball.

GENERAL DESCRIPTION OF THIS INVENTION

This invention relates to an improved mechanical assembly that permits a high velocity return of the ball under any conditions. The ball does not impact on the ground to achieve its return velocity but is attached to a specifically designed elasticized harness system which in one embodiment is supported between two vertical posts that are in turn held in position by two guide ropes at each end and one center strain cable between the posts. The harness is designed to allow the ball to pass the cables and elastics at virtually any position without the cables or elastics becoming entangled. The only guy ropes required are positioned outside the playing area and the inside tension to the posts is achieved with the center strain cable. This invention provides a workable harness arrangement allowing the ball to be suspended in a play position that simulates playing close to the net or on a full sized court. It however only requires the minimum amount of space commonly found in the small back yards of many homes.

More particularly, this invention provides an elasticized ball game, comprising:

two spaced apart securement means, a ball, three elastic cords each having a first end and a second end, the first ends of the three cords being connected together, the second end of one cord being connected to the ball, and the second ends of the other two cords being supported respectively from the two securement means, and a relatively non-elastic cord strung under tension between said securement means, the support of the second ends of the other two cords being effected by attaching said second ends to two swivel devices secured said non-elastic cord at locations respectively adjacent the opposed ends of said non-elastic cord, each said swivel device including a) a substantially cylindrical portion mounted for rotation with respect to said non-elastic cord, b) limiting means restraining the cylindrical portion against longitudinal movement with respect to the non-elastic cord, and c) two relatively stiff arms fixed with respect to the cylindrical portion and extending in substantially opposed directions away from the axis of said cylindrical portion to respective distal ends: the second end of the respective cord being attached through a swivel means to the distal end of one stiff arm, and a counterbalancing weight being provided at the distal end of the other stiff arm.

GENERAL DESCRIPTION OF THE DRAWINGS

One embodiment of the invention will now be described by way of example, with reference to the accompanying drawings, in which.

DETAILED DESCRIPTION OF THE DRAWINGS

Figure 1:
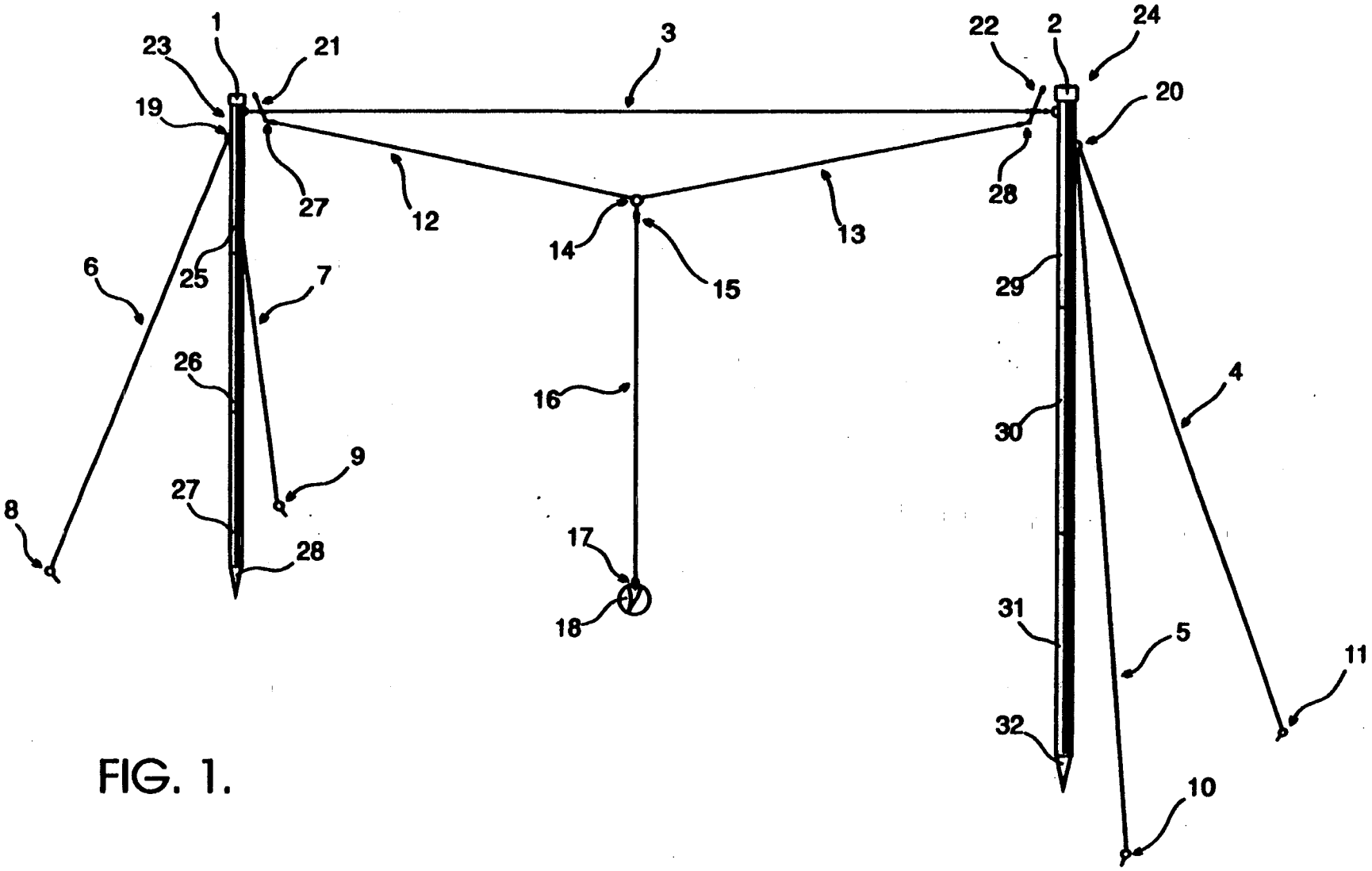
FIG. 1 is a perspective view of the mechanical assembly of the elasticized ball harness in accordance with the invention.

In FIG. 1, an otherwise standard air filled tennis ball 18 is modified include an elastic cord 16 molded or attached at one end to the ball 18. The cord 16 is tied or detachably attached to a brass or other suitable material snap swivel 15 at the other end. The swivel 15 is detachably attached by its snap fastener a rubber O-ring 14. The O-ring 14 is also connected to two lengths of elastic cords 12 and 13. Use of the O-ring as the attachment between elastic cords 12, 13 and 16 prevents eye or other personal injury.

The ball 18, its attachment 17, the elastic cord 16 and the detachably attached swivel snap 15 may be assembled from components of different size and strength. The ball used may simulate a tennis, squash or racquet ball or any other type of ball.

Elastic cords 12 and 13 are tied to swivel snaps 33 (FIG. 2) which in turn are detachably attached to eyes 27' and 28' at the ends of respective wires 21 and 22 constituting swivel devices. Each wire 21, 22 is centrally coiled to provide a substantially cylindrical portion 34 (FIG. 3) mounted for rotation against washers 35 and about hollow shaft 36. Two collars 37 (FIGS. 2 and 3) are secured by two hex screws 38 which tighten against the hollow shaft 36.

Figure 2:
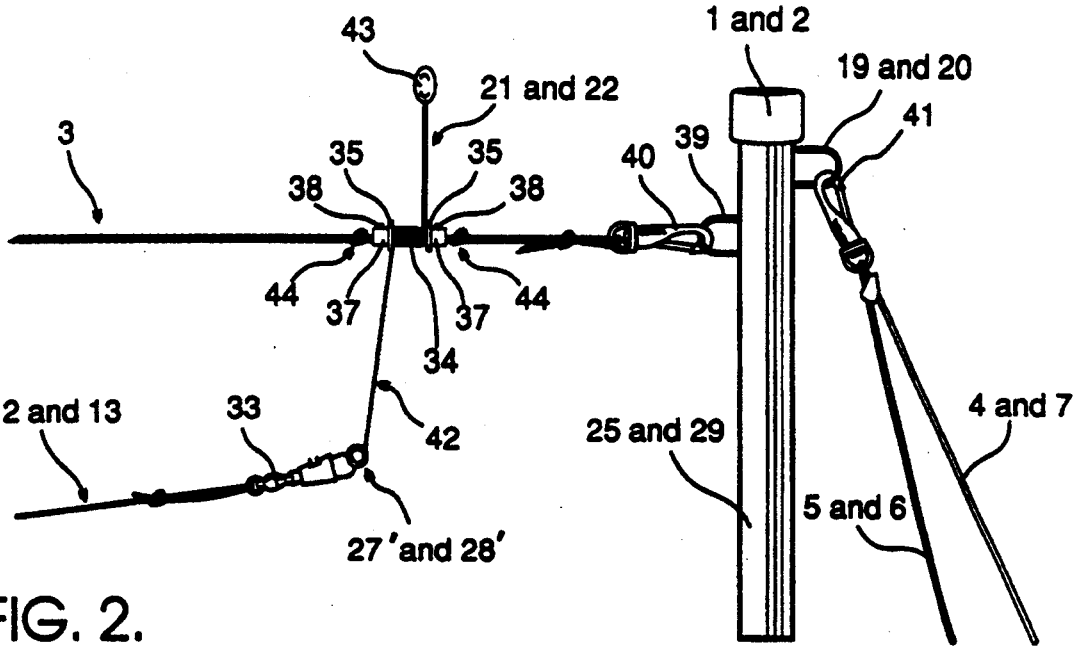
FIG. 2 is a perspective view of a harness mount showing components for the swivel assembly.
Figure 3:
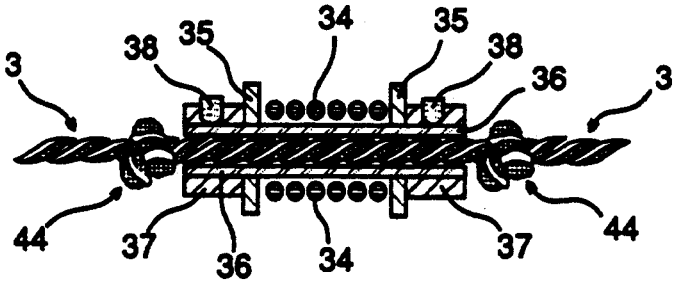
FIG. 3 is a longitudinal sectional view showing the attachment of a swivel collar to a center strain cable.

Each of the two hollow shafts 36 is threaded with a nylon cord 3 and secured with a knot 44 at either side, as shown in FIGS. 2 and 3. The nylon cord 3 is suspended under tension, between two vertical hollow posts spaced apart on the play area, by detachably attached swivel snap fasteners 40 secured to eyelets 39.

The posts are shown in FIG. 1 with the further post assembled in three sections 25, 26 and 27 with protective end cap 1, and ground spike 28. The nearer post has the same construction.

Figure 4:
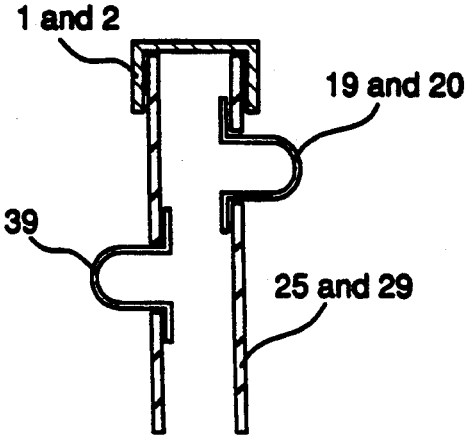
FIG. 4 is a sectional fragmentary view of wire eyelets showing their method of mounting in vertical posts.

In FIG. 2, guywires 4 and 5 are detachably attached to the nearer post with a swivel snap fastener 41 engaging eyelet 20 and secured to wire ground pegs 10 and 11. The eyelets are shown in the sectional drawing of FIG. 4. The eyelets are designed to prevent bodily injury in the event the posts fall, especially during assembly or disassembly or at any other time. The eyelets can collapse into the hollow posts. Protection ends caps 1 and 2 are also to prevent injury if a post falls.

Both posts are held in the vertical position by the tension on cord 3 and the tension in the guywires. The entire structure is held in an upright position in FIG. 1.

A fully inflated modified tennis ball 18 is suspended preferably but not necessarily approximately eighteen inches above the ground when in a position of rest by the elastic cord 16 from elastic cords 12 and 13, this part of the elasticized harness being in the form of a large 'Y' shaped catapult.

When the ball 18 is hit with a tennis racket the ball under its own velocity wall move to an extreme position from the player until the 'Y' catapult has absorbed the inertia of the ball. The catapult will then be in a condition in which the ball has stopped and the potential energy is in the catapult. The tension of the catapult will bring the ball back to the player at almost the same speed as it was originally played at the beginning of the cycle. The device provides the tennis player with another form of game that can be played for practice and exercise purposes in limited space. Another game has been developed in which two players stand opposite to each other and hit the ball on its second return with the 'Y' catapult. It will perform the same whether there is rainfall, snow or sand, unlike conventional lawn tennis that requires the fight weather and operating conditions. The device is also capable of being used in relatively confined spaces such as a small home back yard, unlike the area that is required for a conventional tennis court. Players wanting to practice tennis often find a brick wall to play against. However the energy loss on the rebound of the ball is considerable and the range of shots that can be played is limited. If the ball misses the wall at any time it may well be lost altogether. Them have been other tennis training devices that use an elastic cord attached at one end to a ball and at the other end to a heavy weight. The ball if hit hard travels in an arc to the ground and depending on the softness of the ground may or may not return to the player. The above device provides a much more efficient 'Y' catapult system for which the only energy losses are wind resistance on the ball and the elastic harness together with some minor losses in heat from the compression of the ball and stretching of the elastic. This unique assembly however returns about 90% efficiency throughout the hall's trajectory.

The ball could be hit into a path that takes it above the tension cord 3. If this occurs the specially designed harness will allow the entire 'Y' catapult to rotate about the axis of cord 3 along with wire swivel components. Because the entire component has rotated around cord 3, the elastics do not become entangled or twisted with cord 3. As soon as the ball has reached a position above cord 3 the tension is temporarily out of the catapult and a counter weight 43, provided at the other end of the wire 21, 22 is able to drop under its own weight, assisting the rotation of the wire swivel and preventing the tangling of elastics 12, 13 and 16 around cord 3.

In the event the ball is hit in a path that is under the cord 3 but is above elastics 12 and 13 the brass snap swivels 33 attached to elastics 12 and 13 will rotate and untangle the elastic at their point of attachment to the eyelets 27' and 28' at wires 21 and 22.

In the event the ball spins in a vertical axis on elastic 16 the brass snap swivel at 15 will allow the ball and elastic 16 to freely rotate and untangle.

It will be seen that the entire harness assembly has been designed to allow the elastics 12, 13 and 16 to always untangle, whatever the combination of tennis shots that may be played.

The entire unit is designed for portability and each of the components is easily disassembled. The two posts are preferably assembled in three sections with the bottom section having plastic spikes 28 and 32 inset to the steel tubing for penetrating the ground, and end caps 1 and 2 for protection purposes.

While one embodiment of this invention has been illustrated in the accompanying drawings and described hereinabove, it will be evident to those skilled in the art that changes and modifications may be made therein, without departing from the essence of this invention, as set forth in the appended claims.

The embodiments of the invention in which an exclusive property or privilege is claimed are defined as follows:

1. An elasticized ball game comprising:
two spaced apart securement means,
a ball,
three elastic cords, each having a first end and a second end,
the first ends of the three cords being connected together, the second end of one cord being connected to the ball, and the second ends of the other two cords being supported respectively from the two securement means, and a relatively non-elastic cord strung under tension between said securement means, the support of the second ends of the other two cords being effected by attaching said second ends to two swivel devices secured on said non-elastic cord at locations respectively adjacent the opposed ends of said non-elastic cord, each said swivel device including a) a substantially cylindrical portion mounted for rotation with respect to said non-elastic cord, b) limiting means restraining the cylindrical portion against longitudinal movement with respect to the non-elastic cord, and c) two relatively stiff arms fixed with respect to the cylindrical portion and extending in substantially opposed directions away from the axis of said cylindrical portion to respective distal ends; the second end of the respective cord being attached through a swivel means to the distal end of one stiff arm, and a counterbalancing weight being provided at the distal end of the other stiff arm.

2. An elasticized ball game claimed in claim 1, in which said first ends of said other two cords are connected together by being secured to an O-ring, said one cord being connected to the O-ring through the intermediary of a swivel device.

3. An elasticized ball game claimed in claim 1, in which the securement means comprises two upright post members and in which guywire means is provided for each post member, extending from the respective post member to an anchoring location.

4. An elasticized ball game claimed in claim 1, in which the cylindrical portion and both of the stiff arms are fabricated from a single piece of stiff wire, the cylindrical portion being defined by a helical coil of said wire intermediate the ends thereof.

5. An elasticized ball game claimed in claim 4, in which the securement means comprises two upright post members, and in which guywire means is provided for each post member, extending from the respective post member to an anchoring location.

* * * * *